United States Patent [19]

Giandomenico et al.

[11] 4,130,032

[45] Dec. 19, 1978

[54] HIGH-TORQUE OPEN-END WRENCH

[75] Inventors: Anthony Giandomenico, San Gabriel, Calif.; James M. Dame, Slidell, La.; Harold Behimer, West Covina, Calif.

[73] Assignee: The United States of America as represented by the Administrator of the National Aeronautics and Space Administration, Washington, D.C.

[21] Appl. No.: 828,262

[22] Filed: Aug. 29, 1977

[51] Int. Cl.[2] ..... B25B 13/02; B25B 13/58

[52] U.S. Cl. ..... 81/119; 81/90 B; 81/180 B

[58] Field of Search ..... 81/58.2, 119, DIG. 8, 81/90 B, 121 R, 121 A, 121 B, 180 R, 180 B, 90 D, 180 D

[56] References Cited

U.S. PATENT DOCUMENTS

| | | | |
|---|---|---|---|
| 2,655,827 | 10/1953 | Johnson | 81/121 A X |
| 2,801,561 | 8/1957 | Bonner | 81/90 |
| 4,027,558 | 6/1977 | Fish | 81/58.2 X |

*Primary Examiner*—James L. Jones, Jr.
*Assistant Examiner*—James G. Smith
*Attorney, Agent, or Firm*—Monte F. Mott; John R. Manning; Wilfred Grifka

[57] ABSTRACT

A wrench usable where limited access normally requires an open-end wrench, but which has substantially the high-torque capacity and small radial clearance characteristics of a closed-end wrench. The wrench includes a sleeve forming a nut-engageable socket with a gap in its side, and an adaptor forming a socket with a gap in its side, the adaptor closely surrounding the sleeve and extending across the gap in the sleeve. The sleeve and adaptor have surfaces that become fully engaged when a wrench handle is applied to the adaptor to turn it so as to tighten a nut engaged by the sleeve.

7 Claims, 5 Drawing Figures

FIG. 1
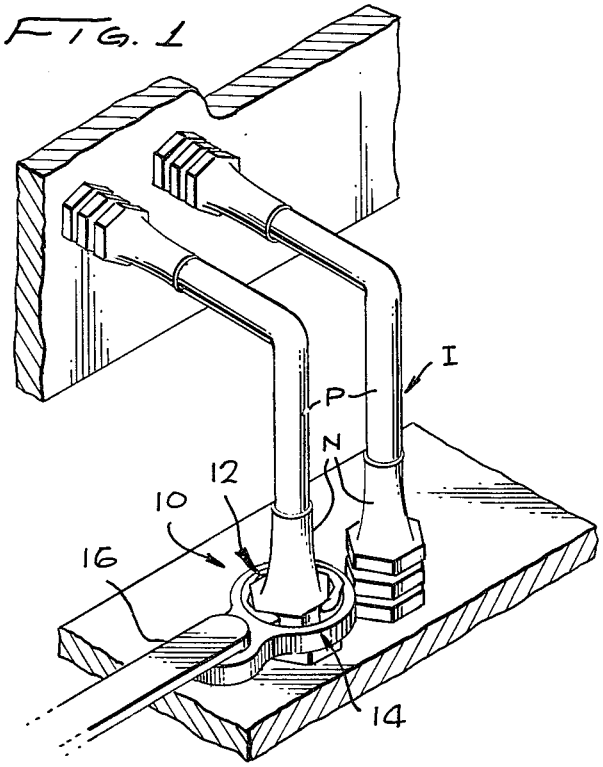
FIG. 3
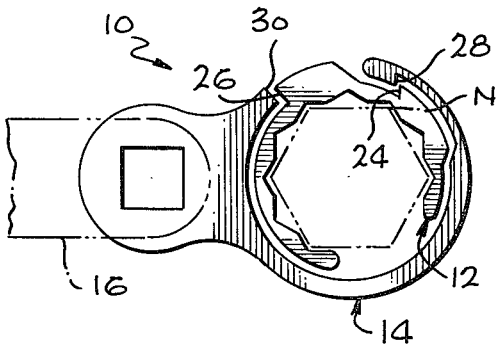
FIG. 4
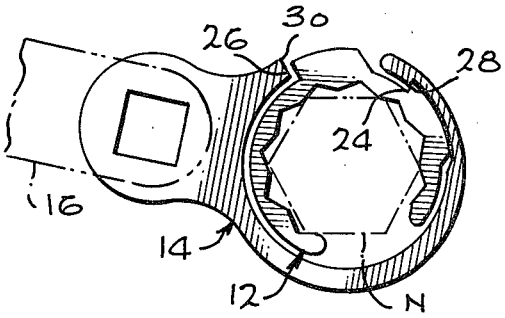
FIG. 2
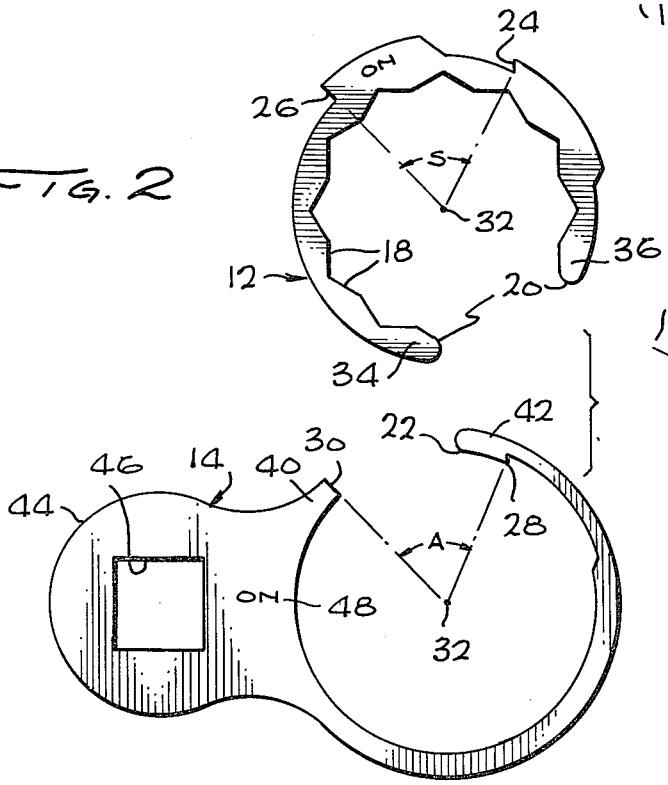
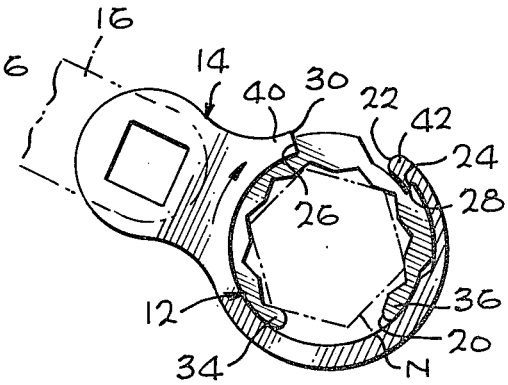
FIG. 5

HIGH-TORQUE OPEN-END WRENCH

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates to wrenches.

In situations where nuts are close to one another or to other elements of a machine, high-torque can be applied by the use of a socket wrench. A typical socket wrench can apply large torque even though the socket has thin walls, because of the fact that there is no gap in the socket to weaken it. Where pipes extend through the nut, a closed socket cannot be installed or removed, and therefore an open-end wrench must be utilized. However, open-end wrenches must have thick walls in order to apply large torques, since the gap in the wrench weakens it, and the thick walls make tightening of closely-spaced nuts difficult. A wrench which had the advantage of socket wrenches of permitting large torques to be applied with thin-walled sockets, and which also had the advantage of open-end wrenches of permitting use on nuts through which pipes or the like extend, would find use in certain limited-access applications.

SUMMARY OF THE INVENTION

In accordance with one embodiment of the present invention, a wrench is provided which can provide large torques with minimal radial clearance, and yet which can be installed where a gap in the socket must be provided. The wrench includes a sleeve forming a nut-engageable socket with a gap in its side, and an adaptor forming a socket with a gap in its side and which can lie closely around the sleeve and extend across the gap in the sleeve. The sleeve and adaptor have engaged torquetransmitting surfaces extending at least partially in radial directions, which enable the adaptor to apply large torque to the sleeve. The fact that the sleeve and adaptor each have a gap in their sides, allows them to be installed in a situation where a pipe or the like extends along the axis of a nut. The fact that the adaptor extends across the gap in the sleeve, means that the adaptor can strengthen the sleeve so that the sleeve can apply a large torque to the nut.

The novel features of the invention are set forth with particularity in the appended claims. The invention will best be understood from the following description when read in conjunction with the accompanying drawings.

BRIEF DESCRIPTION OF THE DRAWINGS

FIG. 1 is a perspective view of a pipe installation, and of a wrench assembly constructed in accordance with the present invention which is being utilized to tighten a gland nut of the pipe assembly.

FIG. 2 is an exploded plan view of the sleeve and adaptor of the wrench of FIG. 1.

FIG. 3 is a plan view of a portion of the wrench of FIG. 1, shown installed on a nut, but prior to the application of torque to the wrench, with some of the clearances of the wrench assembly exaggerated for clarity.

FIG. 4 is a view similar to FIG. 3, but shown after the application of a small torque.

FIG. 5 is a view similar to FIG. 4, but shown after the application of a higher torque than in FIG. 4.

DESCRIPTION OF THE PREFERRED EMBODIMENTS

FIG. 1 illustrates a wrench assembly 10 which is being utilized to tighten one of several gland nuts N of a pipe installation I. In the installation, pipes P pass through the nuts so that a typical socket wrench cannot be utilized. Furthermore, the nuts N are close together so that a typical open end wrench with thick walls for applying high torque, cannot be utilized. The wrench assembly 10 of the present invention employs an inner element or sleeve 12 which directly engages the nut N, an outer element or adaptor 14 that engages the sleeve to apply torque to it and to strengthen it, and a wrench handle 16 which engages and can apply torque to the adaptor.

FIG. 2 illustrates the shape of the sleeve 12 and adaptor 14. The sleeve 12 forms a socket with a plurality of wrench faces 18 on its inside for engaging a nut, and has a gap 20 which enables the sleeve to be installed on a nut through which a pipe or the like extends or which otherwise is situated so that an open-end wrench is normally required. The adaptor 14 forms a socket for receiving the sleeve, the socket having a gap 22 that permits the adaptor to also be installed on a nut through which a pipe or the like extends. The sleeve has a pair of adaptor-engaging surfaces 24, 26, while the adaptor has corresponding sleeve-engaging surfaces 28, 30, all of which extend at least partially in radial directions with respect to the axis 32 of the sleeve and adaptor, to permit the adaptor to apply large torque to the sleeve.

FIGS. 3–5 illustrate the operation of the wrench assembly 10 in the tightening of a nut N. The sleeve 12 is first slipped over the nut to be tightened, and then the adaptor 14 is slipped over the sleeve. The sleeve and adaptor elements are each oriented in the manner illustrated in FIG. 3, with the sleeve surfaces 24, 26 respectively adjacent to the adaptor surfaces 28, 30. Also, the sleeve and adaptor elements are positioned so that the wrench handle 16 can move through a maximum angle during tightening.

FIG. 4 illustrates the sleeve and adaptor after a very slight torque has been applied. The slight torque causes the sleeve surface 24 to engage the adaptor surface 28. However, the other torque-transmitting surfaces are not yet engaged, because the angular separation A of the adaptor surfaces is greater than the angular separation S of the sleeve surfaces when both are undeflected or only slightly deflected.

FIG. 5 illustrates the elements after a moderate torque has been applied to the adaptor in the direction of nut tightening. The additional torque causes the adaptor 14 to bend to a smaller radius so that the adaptor surface 30 engages the sleeve surface 26. Thus, at moderate and higher torque levels, the two sets of sleeve and adaptor surfaces 24, 28 and 26, 30 are engaged. The sleeve and adaptor can be formed so that when surfaces 26, 30 are engaged, the adaptor will have already slightly compressed the sleeve, to provide frictional contact between them along much of their adjacent surfaces.

With the sleeve and adaptor fully engaged, as shown in FIG. 5, a large torque can be applied by the wrench apparatus to the nut N. A large portion of the torque is transmitted from the adaptor surface 30 to the sleeve surface 26. As a result of the torque, the nut tends to force apart the ends 34, 36 of the sleeve which lie on opposite sides of the sleeve gap 20. However, the inside surface of the adaptor supports the sleeve ends against expansion, so that the sleeve remains engaged with the nut. In fact, the large force of the sleeve ends against the inside surface of the adaptor provides friction which aids in the transmittal of torque from the adaptor to the sleeve. The large torque applied by the adaptor surface 30 to the sleeve surface 46 also tends to expand the adaptor so that its ends 40, 42 on either side of the adaptor gap 22 tend to spread apart. However, the engagement of the sleeve and adaptor surfaces 24, 28 prevents such adaptor expansion. The surfaces 24, 28 on the sleeve and adaptor are each undercut to form hooks that resist radially-outward movement of the adaptor end 42. Only a relatively small radial force need be applied at the surfaces 24, 28 due to the large angle of wrap of the adaptor around the sleeve from the adaptor surface 30 to the other adaptor surface 28. In fact, it would be possible to provide only surfaces 24, 28 to transmit torque, although the additional surfaces allow considerably more torque to be transmitted.

The particular adaptor 14 is formed with a wrench-handle engaging portion 44 at one side of the main torque-applying surface 30, and with a square aperture 46 therein for engaging a typical square and of a wrench handle. The fact that the handle-engaging portion 44 lies adjacent to the torque-applying surface 30, results in torque applied to the handle tending to close the gap 30 in the adaptor. Of course, the adaptor can be formed with an integral handle. It may be noted that the wrench assembly can be utilized to loosen a nut, as well as to tighten it. To facilitate such use, one side of the adaptor is imprinted with the word "on" at 48, to indicate that this surface should be normally facing upwardly when the tool is utilized to tighten a nut. The opposite surface of the adaptor is imprinted with the word "off" to indicate that this surface should be normally facing upwardly when the adaptor is utilized to loosen the nut. The sleeve 12 can be similarly imprinted on each face thereof to facilitate use with the adaptor.

Thus, the invention provides a wrench assembly or wrench, that has the advantages of a typical gapless socket wrench of permitting the application of high torque to a nut where there is only a small radial clearance around the nut, and of permitting access to the nut where there is a pipe passing through the nut or other obstruction that requires gaps in any elements to be installed on the nut. This is accomplished by utilizing a sleeve forming a socket with internal wrench faces for engaging the nut, and with a gap in the side walls of the socket to permit insulation on a nut, and by also providing an adaptor with a gap therein for installation around the sleeve. The adaptor closely engages the sleeve, at least near opposite ends of the sleeve gap, to prevent spreading apart of the sleeve, the adaptor also having a surface for applying large torque to the sleeve to turn it. The sleeve and adaptor also are formed with engaged surfaces 24, 28 on a side of the adaptor gap opposite the side portion at which large torque is applied to the sleeve, to prevent spreading apart of the adaptor.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. A wrench usable where limited access normally requires an open-end wrench, but which has substantially the high torque capacity of a closed-end, or socket wrench, comprising:

a sleeve forming a socket with a gap in its side, said sleeve having a plurality of wrench faces on its inside to engage and apply large torque to a nut; and an adaptor forming a socket with a gap in its side, said adaptor formed to surround the region of said sleeve which forms said gap and to lie close to portions of said sleeve which lie on opposite sides of said sleeve gap to resist spreading apart of said sleeve portions;

said sleeve and adaptor having engageable torque-transmitting surfaces extending at least partially in radial directions, between and including a direct radial direction and an undercut, which enable said adaptor to apply torque to said sleeve.

2. The wrench described in claim 1 wherein:

said adaptor has two of said torque-transmitting surfaces, which are angularly spaced and which lie on opposite side portions of said adaptor gap; and said sleeve has two of said torque-transmitting surfaces angularly spaced by a slightly smaller angle than the angular spacing of the torque-transmitting surfaces on said adaptor, whereby large torque applied to the adaptor causes it to contract in radius and therefore provides engagement at both of the torque-transmitting surfaces.

3. The wrench described in claim 1 wherein:

the torque-transmitting surfaces on said sleeve and adaptor are each undercut, so that they prevent radially-outward deflection of the adaptor surface past the sleeve surface.

4. A wrench assembly comprising:

an inner element forming a socket with a gap therein, said inner element having a plurality of internal wrench faces for engaging a nut, and said inner element having a radially outwardly extending hook surface; and an outer element forming a socket with a gap, for receiving said inner element and extending around the gap therein, said outer element having a peripheral torque-applying portion near a first side of said outer element gap for applying force in a direction towards said outer element gap, and said outer element having an inwardly-extending hook surface near a second side of said outer element gap for engaging said hook surface on said inner element to apply torque thereto.

5. The wrench assembly described in claim 4 wherein:

said outer element includes a largely radially-extending torque transmitting surface near said first side of said outer element gap; and said inner element has a largely radially-extending surface positioned to lie adjacent said torque-transmitting surface near said first side of said outer element gap when said hook surfaces of said elements lie adjacent to each other, and said elements are free of largely radially extending torque transmitting surfaces between said surfaces on opposite sides of said outer element gap.

6. The wrench assembly described in claim 5 wherein:

the angular spacing of said hook surface and said radially-extending surface on said inner element, is slightly less than the angular spacing of said hook surface and said torque-transmitting surface of said outer element, when both of said elements are undeflected.

7. A method for turning a nut-like member, comprising:

installing a sleeve that forms a socket with a gap in its side, with a plurality of wrench faces on its inside, and with a torque transmitting surface, around said nut;

installing an adaptor which forms a socket with a gap in its side and with a torque transmitting surface, so that the adaptor surrounds the region of the sleeve which forms the sleeve gap and lies close to portions of the sleeve which lie on opposite sides of the sleeve gap to limit spreading of the sleeve gap, and so that the adaptor torque transmitting surface engages the sleeve torque transmitting surface; and applying torque to the adaptor.

* * * * *